US006550387B1

(12) United States Patent
Vermeersch et al.

(10) Patent No.: US 6,550,387 B1
(45) Date of Patent: Apr. 22, 2003

(54) PROCESSLESS THERMAL PRINTING PLATE WITH WELL DEFINED NANOSTRUCTURE

(75) Inventors: Joan Vermeersch, Deinze (BE); Marc Van Damme, Mechelen (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/638,880

(22) Filed: Aug. 15, 2000

Related U.S. Application Data

(60) Provisional application No. 60/155,784, filed on Sep. 27, 1999.

(30) Foreign Application Priority Data

Aug. 31, 1999 (EP) ..... 99202796

(51) Int. Cl.[7] ..... B41N 1/08

(52) U.S. Cl. ..... 101/456; 101/457; 101/459; 101/467

(58) Field of Search ..... 101/456, 457, 101/458, 459, 462, 463.1, 467

(56) References Cited

U.S. PATENT DOCUMENTS 3,476,937 A * 11/1969 Vrancken ..... 101/470
3,921,527 A * 11/1975 Raschke et al. ..... 101/463.1
4,004,924 A * 1/1977 Vrancken et al. ..... 101/470
5,436,110 A * 7/1995 Coppens et al. ..... 101/459
5,731,124 A * 3/1998 Jonckheere et al. ..... 101/459
6,244,181 B1 * 6/2001 Leenders et al. ..... 101/467

FOREIGN PATENT DOCUMENTS

| | | | |
|---|---|---|---|
| EP | 0 099 264 A2 | | 1/1984 |
| EP | 770495 | * | 5/1997 |
| EP | 0 849 091 A1 | | 6/1998 |
| EP | 881094 | * | 12/1998 |
| EP | 0 881 096 A1 | | 12/1998 |
| EP | 0 931 647 A1 | | 7/1999 |

* cited by examiner

*Primary Examiner*—Stephen R. Funk
(74) *Attorney, Agent, or Firm*—Breiner & Breiner, L.L.C.

(57) ABSTRACT

According to the present invention there is provided a heat-sensitive material for making a negative working non-ablative lithographic printing plate including in a heat sensitive layer thermoplastic polymer beads and a compound capable of converting light into heat on a surface of a hydrophilic metal support, the layer being free of binder, and characterized in that the thermoplastic polymer beads have a diameter between 0.2 $\mu$m and 1.4 $\mu$m.

7 Claims, No Drawings

PROCESSLESS THERMAL PRINTING PLATE WITH WELL DEFINED NANOSTRUCTURE

RELATED APPLICATION

This application claims benefit of provisional application Serial No. 60/155,784 filed Sep. 27, 1999.

FIELD OF THE INVENTION

The present invention relates to a heat-sensitive material for preparing lithographic printing plates.

More specifically the invention is related to a processless heat-sensitive material which yields lithographic printing plates with no scumming and a good ink acceptance.

BACKGROUND OF THE INVENTION

Rotary printing presses use a so-called master such as a printing plate which is mounted on a cylinder of the printing press. The master carries an image which is defined by the ink accepting areas of the printing surface and a print is obtained by applying ink to said surface and then transferring the ink from the master onto a substrate, which is typically a paper substrate. In conventional lithographic printing, ink as well as an aqueous fountain solution are fed to the printing surface of the master, which is referred to herein as lithographic surface and consists of oleophilic (or hydrophobic, i.e. ink accepting, water repelling) areas as well as hydrophilic (or oleophobic, i.e. water accepting, ink repelling) areas.

Printing masters are generally obtained by the so-called computer-to-film method wherein various pre-press steps such as typeface selection, scanning, colour separation, screening, trapping, layout and imposition are accomplished digitally and each colour selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently:

(i) On-press imaging. A special type of a computer-to-plate process, involves the exposure of a plate precursor while being mounted on a plate cylinder of a printing press by means of an image-setter that is integrated in the press. This method may be called 'computer-to-press' and printing presses with an integrated image-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. The best known imaging methods are based on ablation. A problem associated with ablative plates is the generation of debris which is difficult to remove and may disturb the printing process or may contaminate the exposure optics of the integrated image-setter. Other methods require processing with chemicals which may damage the electronics and other devices of the press.

(ii) On-press coating. Whereas a plate precursor normally consists of a sheet-like support and one or more functional coatings, computer-to-press methods have been described wherein a composition, which is capable to form a lithographic surface upon image-wise exposure and optional processing, is provided directly on the surface of a plate cylinder of the press. EP-A-101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure. The latter method requires a curing step and the polymers are quite expensive because they are thermally unstable and therefore difficult to synthesise. EP-A-802 457 describes a hybrid method wherein a functional coating is provided on a plate support that is mounted on a cylinder of a printing press. This method also needs processing. A major problem associated with known on-press coating methods is the need for a wet-coating device which needs to be integrated in the press.

(iii) Elimination of chemical processing. The development of functional coatings which require no processing or may be processed with plain water is another major trend in plate making. WO-90002044, WO-91008108 and EP-A-580 394 disclose such plates, which are, however, all ablative plates. In addition, these methods require typically multi-layer materials, which makes them less suitable for on-press coating. A non-ablative plate which can be processed with plain water is described in e.g. EP-A-770 497 and EP-A-773 112. Such plates also allow on-press processing, either by wiping the exposed plate with water while being mounted on the press or by the fountain solution during the first runs of the printing job.

(iv) Thermal imaging. Most of the computer-to-press methods referred to above use so-called thermal materials, i.e. plate precursors or on-press coatable compositions which comprise a compound that converts absorbed light into heat. The heat which is generated on image-wise exposure triggers a (physico-)chemical process, such as ablation, polymerisation, insolubilisation by cross-linking of a polymer, decomposition, or particle coagulation of a thermoplastic polymer latex. This heat-mode process then results in a lithographic surface consisting of ink accepting and ink repelling areas.

EP-A-786 337 discloses a process for imaging a printing plate, wherein the printing plate is charged over the whole surface and over the whole surface is covered with toner particles, which are charged oppositely. Thereon is the layer, formed by the particles imagewise fixed or imagewise ablated by infrared exposure on the surface of the printing plate. Thereafter the parts which are not fixed are removed and optionally the non-ablated areas are fixed by heating over the whole surface of the plate. This process requires a cumbersome development.

A problem associated with most thermal materials disclosed in the prior art is that these materials are suitable for exposure with either an internal drum image-setter (i.e. typically a high-power short-time exposure) or an external drum image-setter (i.e. relatively low-power long-time exposure). Providing a universal material that can be exposed with satisfactory results on both these types of laser devices known in the art is a requirement difficult to fulfil.

OBJECTS OF THE INVENTION

It is an object of the present invention to provide a processless heat-sensitive imaging material for making lithographic printing plates having excellent printing properties.

It is a further object of the invention to provide a heat sensitive imaging material for making lithographic printing plates wherein the heat sensitive layer is applied on the printing plate.

It is still a further object of the invention to provide a heat sensitive imaging material for making lithographic printing plates which can be used in computer to plate application.

Further objects of the present invention will become clear from the description hereinafter.

SUMMARY OF THE INVENTION

According to the present invention there is provided a heat-sensitive material for making a negative working non-ablative lithographic printing plate comprising in a heat sensitive layer thermoplastic polymer beads and a compound capable of converting light into heat on a surface of a hydrophilic metal support, said layer being free of binder, characterized in that said thermoplastic polymer beads have a diameter between 0.2 $\mu$m and 1.4 $\mu$m.

DETAILED DESCRIPTION OF THE INVENTION

The thermoplastic polymer beads have a diameter between 0.2 $\mu$m and 1.4 $\mu$m, preferably a diameter between 0.5 and 1.2 $\mu$m. When the thermoplastic polymer beads are smaller than said diameters, the printing plate shows scumming, while when the thermoplastic polymer beads are bigger than said diameters, the printing plate does not ink up sufficiently. Although we do not want to be bound by any explanation of these facts, we suggest the following mechanism. Thermoplastic particles with a too small diameter adheres too well to the metallic support and are not completely removed by the ink and/or fountain solution. Thermoplastic polymer beads with a too big diameter, even after coagulation by the infrared irradiation, does not adhere well enough to the metallic support on the imaged areas only thermoplastic polymer beads with a diameter in the claimed range strikes the right balance between adsorption in the imaged areas and removal by ink and/or fountain solution in the non-imaged areas.

Furthermore the hydrophobic thermoplastic polymer particles used in connection with the present invention preferably have a coagulation temperature above 50° C. and more preferably above 70° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition temperature of the polymer particles. Preferably the coagulation temperature is at least 10° C. below the temperature at which the decomposition of the polymer particles occurs. When said polymer particles are subjected to a temperature above the coagulation temperature they coagulate to form a hydrophobic agglomerate so that at these parts the metallic support becomes hydrophobic and oleophilic.

Specific examples of hydrophobic polymer particles for use in connection with the present invention have a Tg above 80° C. Preferably the polymer particles are selected from the group consisting of polyvinyl chloride, polyvinylidene chloride, polyacrylonitrile, polyvinyl carbazole etc., copolymers or mixtures thereof. Most preferably used are polystyrene, polyacrylate or copolymers thereof and polyesters or phenolic resins.

The weight average molecular weight of the polymers may range from 5,000 to 5,000,000 g/mol.

The imaging element further includes a compound capable of converting light to heat. Suitable compounds capable of converting light into heat are preferably infrared absorbing components although the wavelength of absorption is not of particular importance as long as the maximum absorption of the compound used is in the wavelength range of the light source used for image-wise exposure. Particularly useful compounds are for example dyes and in particular infrared dyes which maximum absorption lies between 750 and 11 nm and pigments and in particular infrared pigments such as carbon black, metal carbides, borides, nitrides, carbonitrides, bronze structured oxides and oxides structurally related to the bronze family but lacking the A component e.g. $WO_{2.9}$. The lithographic performance and in particular the print endurance, obtained depends, inter alia, on the heat-sensitivity of the imaging element. In this respect it has been found that carbon black yields very good and favorable results.

A light-to-heat converting compound in connection with the present invention is added to the thermoplastic polymer beads dispersion.

The amount of the compound capable of converting light into heat is in the range of 0.5 to 20% by weight, more preferably in the range of 1 to 10% by weight of the dry layer.

The weight of the imaging layer ranges preferably from 0.1 to 6 g/m$^2$, more preferably from 0.125 to 4 g/m$^2$.

The lithographic base according to the present invention is preferably electrochemically and/or mechanically grained and anodised aluminum.

The aluminum support of the imaging element for use in accordance with the present invention can be made of pure aluminum or of an aluminum alloy, the aluminum content of which is at least 95%. The thickness of the support usually ranges from about 0.13 to about 0.50 mm.

The preparation of aluminum or aluminum alloy foils for lithographic offset printing comprises the following steps: graining, anodizing, and optionally sealing of the foil.

Graining and anodization of the foil are necessary to obtain a lithographic printing plate that allows to produce high-quality prints in accordance with the present invention. Sealing is not necessary but may still improve the printing results. Preferably the aluminum foil has a roughness with a CLA value between 0.2 and 1.5 $\mu$m, an anodization layer with a thickness between 0.4 and 2.0 $\mu$m and is posttreated with an aqueous bicarbonate solution.

According to the present invention the roughening of the aluminum foil can be performed according to the methods well known in the prior art. The surface of the aluminum substrate can be roughened either by mechanical, chemical or electrochemical graining or by a combination of these to obtain a satisfactory adhesiveness of a silver halide emulsion layer to the aluminum support and to provide a good water retention property to the areas that will form the non-printing areas on the plate surface.

The electrochemical graining process is preferred because it can form a uniform surface roughness having a large average surface area with a very fine and even grain which is commonly desired when used for lithographic printing plates.

The roughening is preferably preceded by a degreasing treatment mainly for removing greasy substances from the surface of the aluminum foil.

Therefore the aluminum foil may be subjected to a degreasing treatment with a surfactant and/or an aqueous alkaline solution.

Preferably roughening is followed by a chemical etching step using an aqueous solution containing an acid. The chemical etching is preferably carried out at a temperature of at least 30° C. more preferably at least 40° C. and most preferably at least 50° C.

After roughening and optional chemical etching the aluminum foil is anodized which may be carried out as follows.

An electric current is passed through the grained aluminum foil immersed as an anode in a solution containing an acid. An electrolyte concentration from 1 to 70% by weight can be used within a temperature range from 0–70° C. The anodic current density may vary from 1–50 A/dm2 and a voltage within the range 1–100 V to obtain an anodized film weight of 1–8 g/m2 Al2O3.H2O. The anodized aluminum foil may subsequently be rinsed with demineralised water within a temperature range of 10–80° C.

The anodised aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, and acetals of polyvinyl alcohols formed by reaction with a sulphonated aliphatic aldehyde It is further evident that one or more of these post treatments may be carried out alone or in combination. More detailed descriptions of these treatments are given in GB-A-1 084 070, DE-A-4 423 140, DE-A-4 417 907, EP-A-659 909, EP-A-537 633, DE-A-4 001 466, EP-A-292 801, EP-A-291 760 and U.S. Pat. No. 4,458,005.

The features of the present invention, as specified in the claims, shall be understood as indicated hereafter. The word "image" is used herein in the context of lithographic printing, i.e. "a pattern consisting of oleophilic and hydrophilic areas". The material that is made according to the present invention is negative working, which means that the areas, which are exposed to light, are rendered oleophilic and thus ink accepting due to said exposure. In the context of the present invention, the feature "negative working" may be considered as an equivalent of the feature "non-ablative", since in ablative materials the functional layers are completely removed from the underlying (hydrophilic) metal support upon image-wise exposure so as to obtain a positive image (exposed areas are hydrophilic, ink repelling). Analysis of the exposed areas of the material made according to the method of the present invention indeed showed that the layer or stack of layers is not removed upon image-wise exposure but is converted into a hydrophobic surface on the metal support. The unexposed areas are hydrophilic.

According to the present invention, the heat sensitive layer can be applied as a dry powder by rubbing in the metallic support with said dry powder . Alternatively dry coating methods can also be used, e.g. sputter-coating of the powder on the metallic support. Preferably the heat sensitive layer is applied to the metallic support as an aqueous dispersion, containing between 1 and 30% by weight of thermoplastic hydrophobic polymer beads, more preferably as a dispersion containing between 5 and 20% by weight of thermoplastic hydrophobic polymer beads. Said dispersion can be coated with different coatings techniques, e.g. dipping.

In accordance with the present invention the imaging element is image-wise exposed. During said exposure, the exposed areas are converted to hydrophobic and oleophilic areas.

Said image-forming can be realized by direct thermal recording wherein the thermal transfer is effected by heat radiation, heat conductivity or inductive heat transport. On the heated areas the hydrophobic polymer particles coagulate and forms a hydrophobic area.

Said image-forming can also be effected by irradiation with high intensity light. The heat-sensitive material should then comprise a compound capable of converting light into heat.

Image-wise exposure in connection with the present invention is preferably an image-wise scanning exposure involving the use of a laser or L.E.D. Preferably used are lasers that operate in the infrared or near-infrared, i.e. wavelength range of 700–1500 nm. Most preferred are laser diodes emitting in the near-infrared.

According to the present invention the plate is then ready for printing without an additional development and can be mounted on the printing press.

According to a further method, the imaging element is first mounted on the printing cylinder of the printing press and then image-wise exposed directly on the press. Subsequent to exposure, the imaging element is ready for printing.

The printing plate of the present invention can also be used in the printing process as a seamless sleeve printing plate. In this option the printing plate is soldered in a cylindrical form by means of a laser. This cylindrical printing plate which has as diameter the diameter of the print cylinder is slid on the print cylinder instead of mounting a conventional printing plate. More details on sleeves are given in "Grafisch Nieuws", 15, 1995, page 4 to 6.

The following example illustrates the present invention without limiting it thereto. All parts and percentages are by weight unless otherwise specified.

EXAMPLES

An aluminum support was electrochemically grained using hydrochloric acid, anodized in sulphuric acid and subsequently treated with polyvinylphosphonic acid. The obtained hydrophilic surface was further used for coating with a dispersion, containing hydrophobic thermoplastic polymer beads and a infrared absorbing dye according to formula I Cpd I

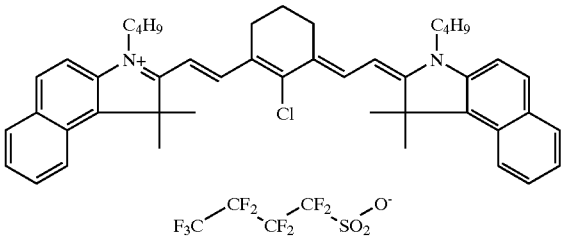

The dispersion is composed of 10% beads of polymer with 0.5% of Dye I. The diameter of the particles is varying between 0.09 μm and 2.6 μm. The polymeric beads of various particle size were coated on the aluminum support.

Material 1: The diameter of the polystyrene particles is 90 nm. The thickness of the layer after drying is varying in a range from 400 mg/m$^2$ to 800 mg/m$^2$. The coating solution is composed with 2–4% of the dispersion and water. After coating, the layer was dried for 10 minutes at a temperature of 50° C.

Material 2: The diameter of the polystyrene beads was 0.8 μm. The thickness of the layer after drying is varying in a range from 130 mg/m$^2$ to 1300 mg/m$^2$. The coating solution is composed with 12.38–24.76% of the dispersion and water. After coating, the layer was dried for 10 minutes at a temperature of 50° C.

Material 3: The diameter of the polystyrene beads was 1.5 μm. The thickness of the layer after drying is varying in a range from 244 mg/m$^2$ to 2440 mg/m$^2$. The coating solution is composed with 23.24–46.43% of the dispersion and water. After coating, the layer was dried for 10 minutes at a temperature of 50° C.

Material 4: The diameter of the polystyrene beads was 2.6 μm. The thickness of the layer after drying is varying in a range from 130 mg/m$^2$ to 1300 mg/m$^2$. The coating solution is composed with 12.38–24.76% of the dispersion and water. After coating, the layer was dried for 10 minutes at a temperature of 50° C.

Subsequently, the aluminum support covered with heat sensitive layer was exposed with a 830 nm diode laser (Isomet—spot size 11 μm—at a speed of 3.2 m/s; i.e. a pixell dwell time of 3.4 μs.) The image plane power vas varied: 148 mW, 220 mW and 295 mW were used.

The obtained printing elements were printed on a conventional offset printing machine with a conventional ink and fountain solution. Printing was started without any treatment between imaging and the press start, and resulted in good prints with good image quality for material 2 while for material 1 scumming was present and materials 3 and 4 did not ink-up sufficiently.

What is claimed is:

1. A heat-sensitive material for making a negative working non-ablative, lithographic printing plate comprising in a heat-sensitive layer thermoplastic polymer beads and a compound capable of converting light into heat on a grained and anodized aluminum support, said layer being free of binder, wherein said thermoplastic polymer beads have a diameter between 0.2 μm and 1.4 μm and wherein the grained and anodized aluminum support has a center-line average roughness value between 0.2 μm and 1.5 μm.

2. A heat-sensitive material according to claim 1 wherein said thermoplastic polymer beads are polystyrene, polyacrylate homo and/or copolymers, polyesters or phenolic resins.

3. A heat-sensitive material according to claim 1 wherein the compound capable of converting light into heat comprises a dye whose maximum absorption lies in the infrared.

4. A heat-sensitive material according to claim 3 wherein said infrared absorbing dye absorbs maximally between 750 and 1100 nm.

5. A method for preparing a negative working non-ablative printing plate comprising imaging with an infrared laser the heat sensitive material according to any one of claims 1 to 4, thereby increasing adhesion of the beads to the surface of the metal support, and removing non-exposed beads from the surface of the metal support on non-imaged areas under the influence of an ink and/or fountain solution.

6. A method according to claim 5, wherein the metal support is mounted on a cylinder of a rotary printing press.

7. A method according to claim 5 wherein the metal support is a sleeve or a cylinder of a rotary printing press.

* * * * *